United States Patent [19]

Witt et al.

[11] 3,988,187

[45] Oct. 26, 1976

[54] METHOD OF LAYING FLOOR TILE

[75] Inventors: Alvin E. Witt; Homer Breault, both of Pine Glen, Pa.

[73] Assignee: Atlantic Richfield Company, Los Angeles, Calif.

[22] Filed: Apr. 28, 1975

[21] Appl. No.: 572,370

Related U.S. Application Data

[62] Division of Ser. No. 330,159, Feb. 6, 1973, Pat. No. 3,902,293.

[52] U.S. Cl. ..... 156/71; 52/302; 52/392; 52/398; 156/267; 428/53

[51] Int. Cl.[2] ..... E04B 5/00

[58] Field of Search ..... 52/198, 302 X, 303, 52/392 X, 398 X; 156/71, 267; 428/53

[56] References Cited

UNITED STATES PATENTS

| | | | |
|---|---|---|---|
| 1,995,264 | 3/1935 | Mason | 52/589 |
| 3,273,296 | 9/1966 | Soulon | 52/302 |
| 3,579,410 | 5/1971 | Barrett | 156/71 |
| 3,657,852 | 4/1972 | Worthington et al. | 52/392 |

*Primary Examiner*—Edward G. Whitby
*Attorney, Agent, or Firm*—John R. Ewbank

[57] ABSTRACT

Laying floor tiles is more convenient because the floor tiles are provided with tongues which can be fitted readily into grooves in adjacent tiles because the depth of each groove is less than the magnitude of the portion of a tile which is overhanging a portion of the adjacent tile. Such overhanging and underfitting relationships supplement tongues along adjacent sides into grooves of two adjacent tiles. Peripheral floor tiles can be anchored, but central area tiles can be free from the conventional adhesion to the subflooring. Venting for moisture equilibration between the atmosphere and a sub-flooring such as a concrete slab is achieved because of the absence of adhesive between vertical walls of adjacent tiles.

1 Claim, 10 Drawing Figures

METHOD OF LAYING FLOOR TILE

RELATED APPLICATION

This is a division of application Ser. No. 330,159 filed Feb. 6, 1973, now U.S. Pat. No. 3,902,293 of Sept. 2, 1975.

FIELD OF THE INVENTION

This invention relates to floor tiles and to methods for laying resilient floors by adhering tiles to adjacent floor tiles.

BACKGROUND OF THE INVENTION

Numerous problems have plagued both the design and maintenance of gymnasium floors. Hardwood has had many advantages, but maintenance thereof has sometimes been costly. For some hardwood floor situations such as in foyers, requiring no resiliency, the use of hardwood impregnated with a suitable plastic monomer and the in situ polymerization thereof has provided an impregnated structure having sufficient durability to reduce maintenance costs significantly. The plastic impregnated wood is not completely free from troublesome amounts of dimensional change attributable to changes of humidity. The humidity-induced expansion of plastic-impregnated hardwood of the prior art has not been as troublesome in small areas as in gymnasiums or other large areas covered with a flooring involving wood products. Gymnasium floors have sometimes buckled because large forces are generated by the humidity-induced expansion of unmodified hardwood.

Plywood has less humidity induced expansion than wooden strips. Various combinations of wooden strips, resilient pads, plywood subflooring, and hardwood floor have sometimes been employed for seeking to achieve a combination of dimensional stability and limited resilience for the total floor structure. Basketball players do not like to play on a concrete or other floor completely lacking resiliency. Basketball players can recognize the presence or absence of the desired degree of resiliency in a gymnasium floor. A resilient floor is significantly more valuable than an unyielding floor because its resiliency can be recognized by some. Gymnasium floors have been constructed with steel channels anchored to the concrete subflooring, with the hardwood securely anchored at a sufficient number of points to the steel channels to bring about compression and stretching of the hardwood instead of dimensional changes, as described in Robbins U.S. Pat. No. 3,271,916. Attempts have been made to provide air conditioning systems sufficiently reliable and perfect to minimize humidity changes for overcoming the problems of dimensional change in hardwood floors, but costly buckling has sometimes occurred at gymnasiums equipped with air conditioning.

Because all of the hardwood systems have involved so much maintenance and installation expense, a variety of alternatives, including polyurethane flooring and other plastic flooring have been employed in gymnasiums. Although hundreds have struggled with the problem, architects have long been frustrated by the conspicuous absence of any moderately priced system for building a resilient basketball floor using a low-cost field application and permitting long-term low-cost maintenance, notwithstanding the long-standing demand for such moderately priced basketball floors.

SUMMARY OF THE INVENTION

In accordance with the present invention, a floor system is provided having the combination of wear resistant top surface, long-lasting resiliency, simplicity of field application, low maintenance requirements and dimensional stability throughout all of the plausible changes of humidity. Such floor system is achieved by the use of a floor tile having a plurality of layers bonded to each other at the factory. The bottom layer is a sheet of molded tangle of thermoplastic fibers containing a multiplicity of spheroidal cells of compressed gas within the fiber. Thus, the resiliency of each fiber has been attributable primarily to the closed cells of gas at superatmospheric pressure in the fibers. Such resiliency is analogous to the resiliency of a tennis ball, as distinguished from the resiliency of a sponge rubber ball in which the gas in the cells is at about ambient pressure instead of superatmospheric pressure.

A major portion of the tile thickness consists of a wafer board composition, thereby achieving outstanding dimensional stability. Such major thickness of the tile, with the wafer board edges of adjacent tiles being in abutting relationship permits ease of laying the floor tiles. There can be one or two or more lamina of such wafer board in such major thickness of the tile.

A relatively thin top layer provides toughness and a wear-resistant surface. Such top layer requires minimized maintenance attributable to the impregnation and in situ polymerization of methyl methacrylate or other appropriate monomer or impregnated plastics. A flame retardant is also impregnated into the top layer and sealed therein by the in situ polymerization of the monomer. A variety of synergistic advantages are attributable to such combination of wood, flame retardant, and in situ polymerized plastic. The wear resistant layer is bonded to most of the area of its underneath wafer board member but has an overhanging portion adapted for contact with boundary portions of two adjacent wafer board members. Factory applied pressure sensitive adhesive may, if desired, be employed so that at the time of field application, the floor tiles are laid so that each tile is bonded to four adjacent tiles. If there is only a single lamina of wafer board, then somewhat wider overhanging relationships may be advantageous. If there are two lamina of wafer board, whereby tongue and groove associations of the overhanging portions of adjacent tiles are feasible, then the depth of groove (corresponding to length of tongue) can be only a small fraction of the tile dimension. Pressure sensitive adhesive factory applied in the groove is protected by its remote location until the laying of the tile, thus increasing the convenience of the tile to the contractor laying the floor. No anchoring to the sub-floor (e.g., a concrete floor) is necessary or desirable throughout most of the central area. At the periphery, if desired, and particularly in zones in which tile trimming is needed, the tiles can be suitably anchored to the subfloor. Much of the central area of the floor can be adequately bonded together because of the pressure sensitive adhesion of the overhanging portions of adjacent tiles or T and G edge bond.

DESCRIPTION OF THE PREFERRED EMBODIMENTS

Figure 6:
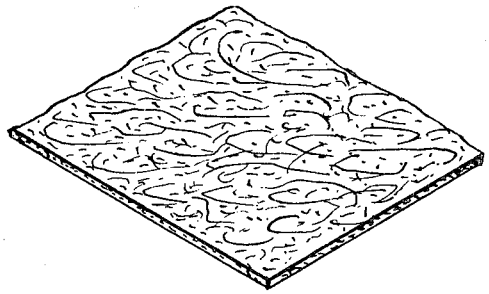
FIG. 6 is a schematic view of a sheet molded from a tangled web of filaments of FIG. 5.

Concrete floors sometimes contain amounts of water or moisture which vary from time to time, attributable to such factors as recent pouring of the concrete, pouring as a slab on the ground and/or other factors. It is important that the moisture content of a concrete subfloor be allowed to equilibriate with atmospheric moisture. The present invention features a plurality of floor tiles laid in such a manner that at each zone where four tiles meet, as well as at some edge zones between two tiles, vent paths are provided between the zone of the subflooring and the atmosphere. At the subflooring zone, there is an abundance of generally horizontal paths for moisture diffusion because the resilient layer is a molded tangled web of fibers (schematically shown in FIG. 6) through which gas streams readily flow. Such molded sheet of resilient material, thus aids in the equilibriation between the atmosphere and any moisture in the subflooring by promoting vertical diffusion at the joints between the tiles rather than through the tile.

Figure 5:
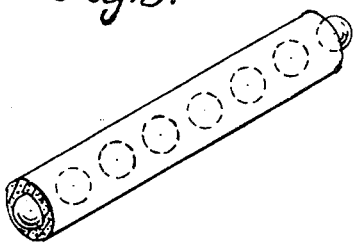
FIG. 5 is a schematic view of a thermoplastic filament having spheroidal cells of gas at superatmospheric pressure.

Many types of resilient material are seriously damaged if a load is applied for a period of weeks to significantly compress the resilient material. An important feature of the present invention is the utilization of a molded sheet of a network of fibers comprising spheroidal chambers or cells of gas at superatmospheric pressure. FIG. 5 is a schematic showing of fibers featuring spheroidal chambers or cells containing compressed gas at a pressure above atmosphere. The fibers with compressed gas cells are adapted to be restored to excellent resiliency even after prolonged significant compression.

Some conventional sponge rubber balls, when kept under a heavy load, undergo "compression set" to develop a distorted non-spherical shape after the load is removed. However, the ideal tennis ball featuring compressed gas in an impermeable spheroidal chamber, can withstand a heavy load for months and retain original resiliency. Thus the ideal tennis ball has zero compression set and its resiliency can accordingly be distinguished from the resiliency of the previously described conventional sponge rubber ball. Similarly, the sheets of networks of hollow (an abbreviated requirement for containing compressed gas cells) fibers have substantially no permanent compression set when the loads are less than would burst any of the compressed gas chambers.

It can be noted that the sheets of a molded network of fibers containing compressed gas have been designed primarily as underlay for carpets. The concept that such sheets have ability for imparting resiliency for gymnasium floors had never been demonstrated prior to the present invention.

Heretofore floors have been laid by positioning tiles of appropriate shape adjacent to each other. It is most convenient to describe each laying of floor tiles which are square. It should be recognized that the shape of the floor tile is suitable for floor tile usage, and although square tiles have been popular, the present invention embraces any and all other established floor tile shapes such as rectangular, hexagonal, or the like.

Figure 1:
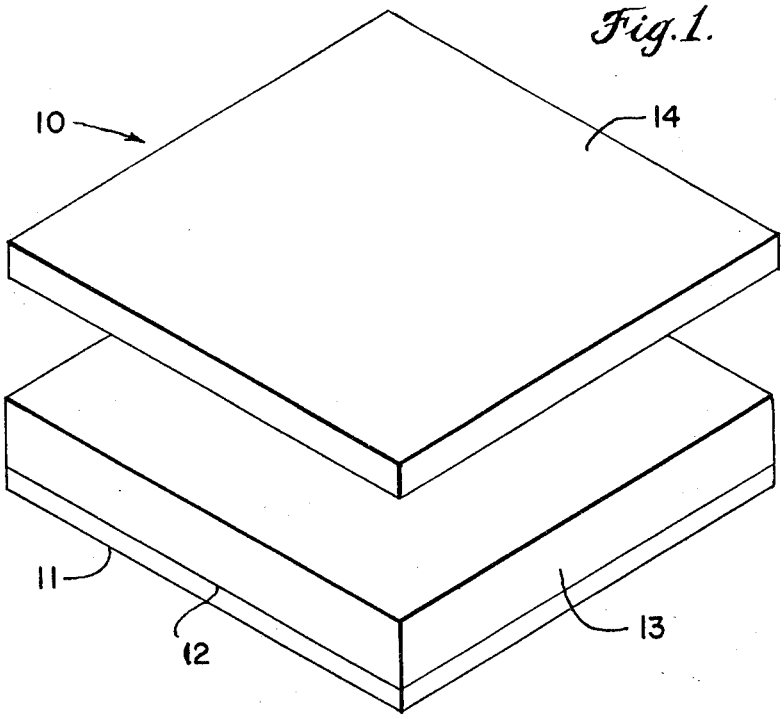
FIG. 1 is a schematic, exploded view of some of the components of the embodiment of FIGS. 2–8, the staggered relationship of the layers not being shown.

Each of the several layers of a square tile 10 has substantially the same horizontal dimensions as indicated schematically in FIG. 1. The resilient sheet 11 is tangled, hollow fibers is bonded to the bottom of the next higher strata of a wafer board layer 12. The wafer board layer is thick enough to permit convenient laying of the tiles with some vertical walls of wafer board layers of adjacent tiles in abutting relationship. No adhesive is provided between the principal abutting walls between the floor tiles, inasmuch as this is a gas permeation zone allowing the concrete floor to gain and lose moisture. Such absence of adhesive between the walls of the bottommost strata of the wafer board layer also helps to make possible a limited amount of resilient movement between the abutting edges of adjacent tiles.

Figure 7:
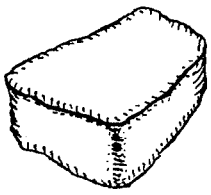
FIG. 7 is a schematic view of an irregularly shaped wafer of wood chipped from a log.
Figure 8:
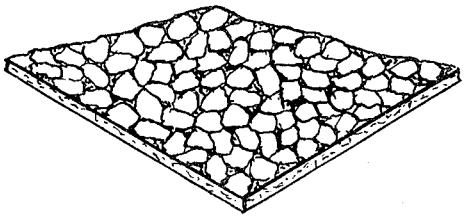
FIG. 8 is a schematic view of a wafer board resulting from coating a plurality of irregularly-shaped chips of FIG. 7 with a precursor, arranging such chips with random distributions of grain in a mold, and pressure curing the chips into a wafer board.

FIG. 7 is a schematic view of a wafer. FIG. 8 is a schematic view of a strata of wafer board. A variety of sizes of wafers of wood are oriented with sufficient variation of grain orientation that, after the molding of the wafer board, the variations in dimensions in any chips attributable to changes in humidity, are compensated for internally within the wafer board, whereby the molded wafer board retains reliable dimensional stability throughout the entire humidity range. Wafer board has been marketed with emphasis upon its price and aesthetic decorativeness, and the present invention represents a breakthrough in utilizing wafer board for floor tiles to achieve dimensional stability throughout a wide humidity range.

The top wear resistant layer is characterized by having a suitable wood structure but is characterized primarily by being impregnated with the combination of a fire retardant and a plastic which has been polymerized within the wood after impregnation of the liquid precursor mixture. Such chronology of impregnation of a liquid precursor mixture followed by polymerization to an attrition resistant plastic product is described herein as in situ polymerization.

Most varieties of plastic impregnated wood, once the combustion has started, tend to burn with even greater intensity than is possible in ordinary wood. Monomers such as vinylidene fluoride or vinyl chloride, which might impart flame retardancy have had engineering disadvantages prompting selection of methyl methacrylate and other flammable monomers for in situ polymerization of plastic. By the combination of suitable fire retardants and the plastic, the combination of wear resistance and safety from excessive fire hazard is achieved. The wooden structure may be a hardwood parquet tile or it may be a thin layer of wafer board or it may be a particle board or any other type of wooden structure suitable for floor usage.

Particular attention is called to the staggered positioning of the top layer with respect to underlying layers. Only a portion of the wear resistant layer is bonded at the factory to the next underlying strata of unimpregnated wafer board. A small unbonded boundary zone along two edges of such waferboard strata is thus exposed. Moreover, the top layer overhangs the next underlying strata to provide an overhanging projection along the opposite two edges. The combination of the boundary zones of wafer board and the overhanging projection of the top layer permits each tile to have overlapping relationships with four adjacent tiles in a floor laying technique which can proceed rapidly. Pressure sensitive adhesive (with or without protective peelable strips) can be applied at the factory to at least segments of the boundary portions of the wafer board face and/or to the under portion of the overhanging projection of the wear resistant layer. Alternatively, instead of applying adhesive at the factory, the adhesive could be applied at the site while still providing a more rapid installation of a gymnasium floor than has been conventional. The overlapping relationships of the tiles overcomes problems attributable to floor laying procedures requiring either adhesion of abutting vertical walls of adjacent tiles or adhesion of central area tiles to the subflooring.

Referring now to the drawings, FIG. 1 shows a modified exploded view of the several components of the floor tile. A bottom layer 11 consists of a molded sheet of a network of compressed gas-containing fibers or filaments. FIG. 5 is a schematic showing of a series of pressurized gas chambers along the axis of a filament employed in manufacturing bottom layer 11. The network of such filaments is molded into a sheet schematically shown in FIG. 6. One brand of molded sheet of fibers having cells of compressed gas is marketed as Pneumacel underlay for carpets. The molded fiber network provides a resilient sheet which, so long as the pressurized gas remains within the chambers in the fiber, retains its initial resiliency even after prolonged periods of supporting heavy weights. Thus, the substantially zero propensity to set when compressed distinguished such resilient sheet from the several conventional varieties of cellular plastic. In some sponge rubber, relatively large gas cells are distributed in a random manner inconsistent with the nature of the resilient fibers of layer 11. In some cellular plastics, the porosity of the walls of the gas cells permits gas to diffuse from and into such cells, such cellular plastic tending to set when subjected to prolonged compression.

A thin layer of adhesive 12 serves to bond the resilient sheet 11 to the next higher strata oonsisting of wafer board. In the embodiment of FIGS. 1–8, there is only a single strata of waferboard in a middle layer 13 of the tile. Such wafer board layer 13 constitutes a major portion of the thickness of the floor tile. Wood chips or wafers such as shown schematically in FIG. 7 are coated with a plastic, and assembled with the grains of the wafers appropriately oriented, and with appropriate cavities between wafers and with wafers bonding to each other at appropriate points, as distinguished from a complete filling of the space with the wood product. Thereafter, the wood wafers are pressure molded to provide a structure schematically shown in FIG. 8. The wafers are bonded to each other at certain zones so that there are cavities throughout the panel and so that each wafer can undergo small dimensional changes without weakening the inter-wafer bonding. Because there is internal compensation within the panel, and a balancing of the humidity-induced dimensional changes within each wafer, the panel of wafer board has substantially no dimensional changes attributable to variations in the moisture content of the atmosphere. Humidity changes can bring about small dimensional changes within each wafer. The nature of the inter-chip bonding, and the variations in grain orientation are such that the wafer board retains its originally intended dimensions throughout the entire range of humidity changes. One brand of wafer board is marketed as Aspenite panels as decorative competitor for plywood. The absence of dimensional change while still utilizing a wood product is a very important characteristic of the middle layer 13, inasmuch as the edges of portions of middle layers of adjoining tiles are abutting, whereby buckling of the floor would readily occur if there were moisture-induced expansion of the wood structure in tiles merely placed upon (not adhered to) the subflooring.

In order to focus attention upon the fact that an attrition resistant layer 14 embraces substantially the same floor area as the wafer board 13, FIG. 1 shows such two layers vertically displaced without staggering. The attrition resistant layer 14 is a wood structure, such as a wire stapled assembly of hardwood strips suitable as a hardwood tile for parquet flooring. Alternatively, the layer 14 might be a particle board, plywood, or other wooden structure. Whatever type of wooden structure is employed, the attrition resistance is obtained by reason of the impregnation of the wooden structure with a precursor characterized by a mixture of plastic monomer and fire retardant. Of particular importance, the wooden structure of the attrition resistant layer 14, after impregnation with the combination of flame retardant and monomer, is polymerized in situ. Certain advantages accrue from promoting such polymerization predominantly by radiation (i.e., generally non-catalytic, but comprising the thermal polymerization attributable to the restricted cooling of the radiant polymerization) from radioactive cobalt. The substantial absence of catalysts in the situ polymerized plastic imparts outstanding attrition resistance to the top layer. The attrition resistance of the hardwood or other wooden structure is enhanced by the combination with the in situ polymerized plastic.

Because of the outstanding attrition resistance of the top layer 14, the problem of preserving an attractive appearance for the top layer is greatly simplified, thus providing a maintenance advantage for the plastic-wood structure.

Figure 2:
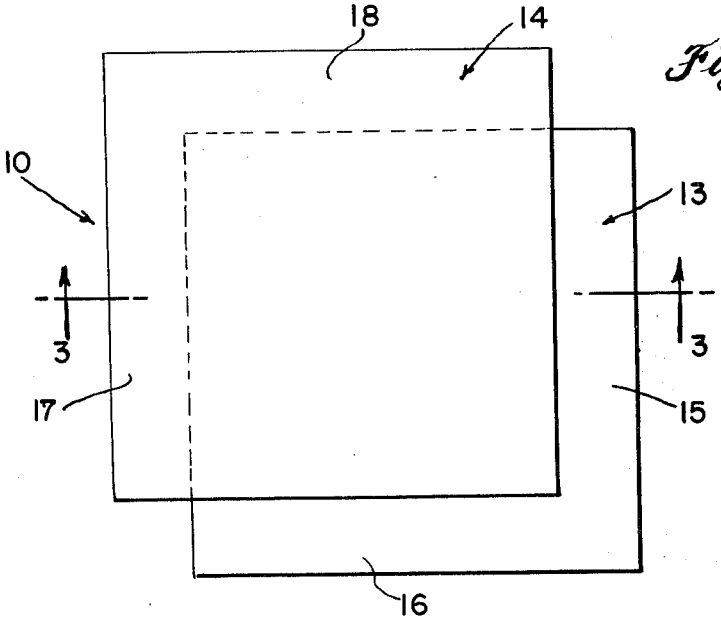
FIG. 2 is a top view of an embodiment of an assembled tile of one embodiment.

The floor tile of FIGS. 1–8 features a staggered mounting of the attrition resistant layer 14, as shown in the top view of FIG. 2. Thus, the principle portion of the area of the attrition resistant layer 14 is aligned with a principle area of the wafer board 13, but the staggering exposes two boundary zones 15 and 16 which meet at a corner of the tile. At the diagonally opposite corners of the tile, there are overhanging lips 17 and 18 of the attrition resistant layer 14.

Figure 3:
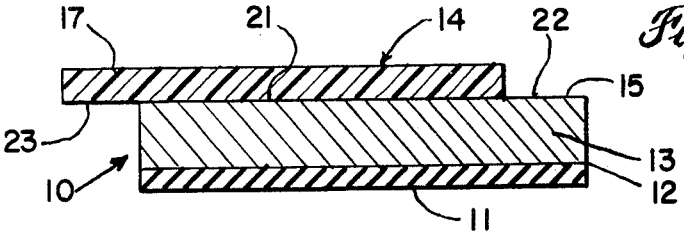
FIG. 3 is a cross section of a portion of a tile, taken on 3—3 of FIG. 2.

The schematic sectional view of FIG. 3 shows that the tile 10 includes the resilient sheet 11, bonded by adhesive 12 to the bottom of the single strata of wafer board 13, above which is positioned an attrition resistant layer 14 having an overhanging lip 17 which exposes boundary zones 15 of the wafer board 13.

At the factory, an adhesive 21 secures the attrition resistant layer 14 to the wafer board 13. It is sometimes desirable to provide factory application of pressure sensitive adhesive 22 to the top of boundary zone 15 and/or underneath the surface of lip 17 of attrition resistant layer 14. Alternatively, adhesive can be applied to one or both of such zones as a part of the laying of the floor tiles. By either chronology, the floor tiles are locked together by the adhesion between adjacent tiles at such overhanging portions.

Figure 4:
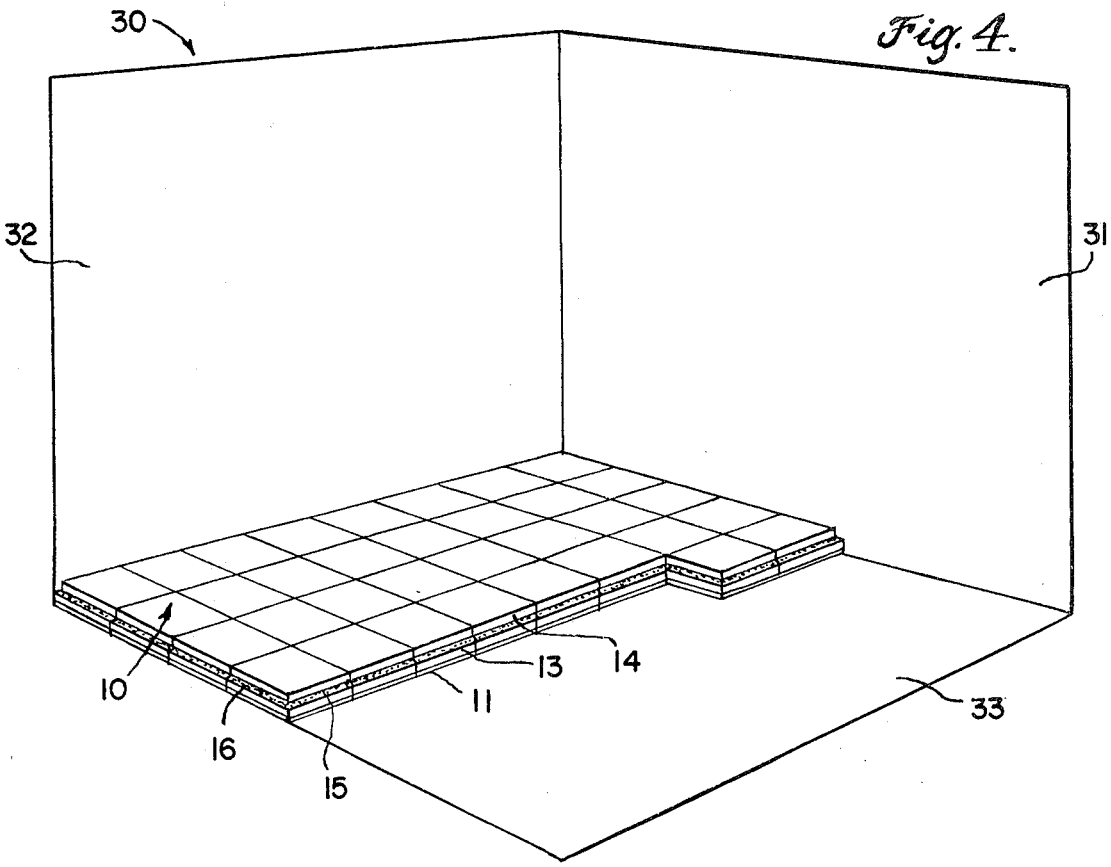
FIG. 4 is a schematic view of a portion of an area in which the tiles of FIG. 2 are laid.

As shown in FIG. 4, a room 30 has walls 31, 32, and a subflooring 33. A plurality of floor tiles 10, corresponding generally to the floor tile previously described, are laid so that the attrition resistant layers of the tiles 10 are staggered with respect to the wafer board layers. Particular attention is directed to the ease of laying tiles 10 throughout the floor of a room. As a new tile is laid down, its thickness of wafer board 13 can be positioned adjacent one or more already laid tiles, and the overlapping lip 17 of the tile pressed against the boundary portions 15 of adjacent tiles. In this manner, each tile is adhered to four adjacent tiles. At the periphery of the room, where tile-trimming is ordinarily required, the resilient layers can be adhered to the subflooring, thus providing at least a partial anchoring of the entire floor system to the subflooring while still permitting most of the floor tiles to retain a controlled amount of independent vertical resiliency of a type not readily achieved when each floor tile is adhered to the subflooring.

Attrition resistant flooring can be applied to an area by a method which includes the steps of: placing a plurality of tiles in a central area, there being overhanging-underfitting relationship of straight line boundary portions which in the unadhered condition permits two adjacent tiles to be slideably adjustable with respect to each other, whereby each tile has overhanging-underfitting relationship with four adjacent tiles, said tiles having boundary portions adapted for an underfitting relationship along two edges which meet at a corner, said tiles being adhered to each other only at the overhanging-underfitting zone, said tiles not being adhered to the subflooring, said adhering of overhanging-underfitting portions being the only limitation to the fitting of an edge of a tile to the edge of its adjacent tile; trimming tiles at the periphery of the area; and anchoring selected tiles at the periphery of the area to the subflooring while retaining the non-adhering relationship of the floor tiles and sub-flooring throughout such central area.

Figure 9:
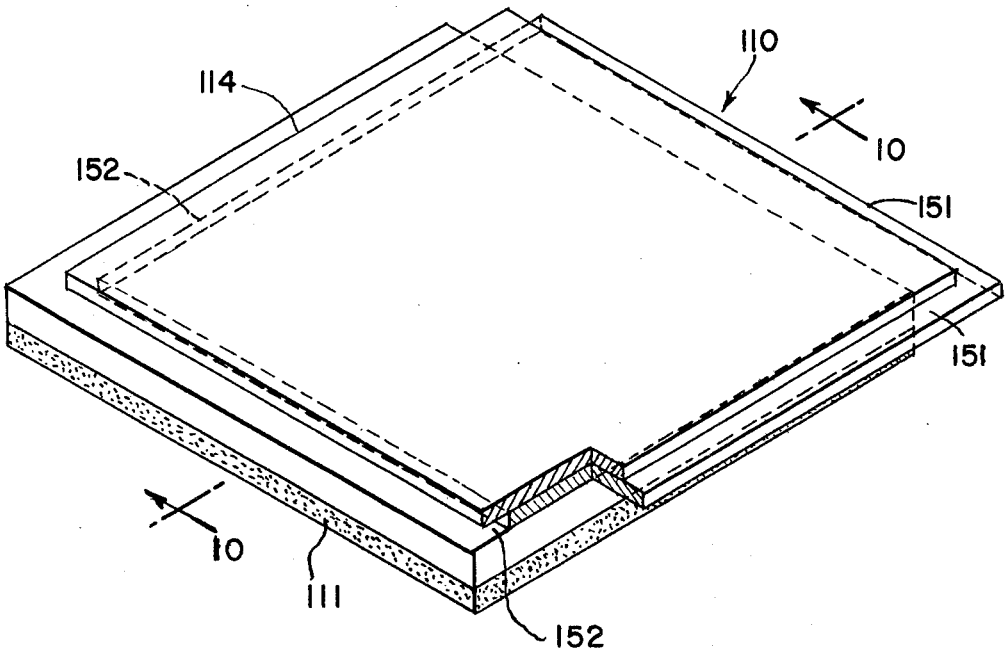
FIG. 9 is an isometric view of a modification with a corner portion shown in section to better show the groove and tongue.
Figure 10:
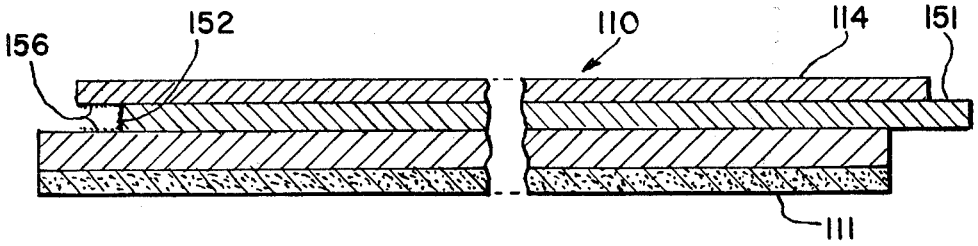
FIG. 10 is a cross section on the line 10—10 of FIG. 9.

An alternate embodiment of a rectangular floor tile is shown in FIGS. 9 and 10. A floor tile 110 comprises a resilient layer 111 and a top attrition resistant layer 114 corresponding essentially to that of the previously described tile 10. A principal thickness of the tile 110 is designated as a wafer board layer 113 comprising two strata, 151 and 152. As shown in FIG. 9, the staggering relationships amongst the attrition resistant layer 114 with respect to the upper wafer board strata 151 and lower wafer board 152 are such that tongue and groove fittings between adjacent tiles are feasible, the overhanging portion of strata 151 constituting a tongue 153 adapted to fit within a groove 154 formed between the bottom of the attrition resistant layer 114 and the top of the lower strata 152 of the wafer board layer 113. In order to achieve a convenient insertion of the tongue in the groove at the time of laying the floor, the depth of the groove 154 is less than the magnitude of the overhang of tile 10. The fact that the bottom layer 111 had adequate resiliency aids in the insertion of each of the two tongues in their respective grooves as a tile is pushed into engagement with two adjacent tiles. As shown in FIG. 10, pressure sensitive adhesive can be distributed as a film 156 along at least portions of the groove 154, whereby the tile may be shipped from the factory with the pressure sensitive adhesive factory applied, but without any protective paper thereover. It is only at the time when the floor is being laid, and the tongue is inserted in the groove that the pressure sensitive adhesive encounters a surface to which it can bond. The remote location of the pressure sensitive adhesive permits convenient handling of the tiles prior to the laying of a floor while still providing adequate bonding between adjacent tiles in the central area of the laid floor.

Various other modifications for bonding a floor tile to two boundary portions of adjacent tiles by reason of overhanging portions are possible, and the overhanding lip of tile 10 or the tongue 153 and groove 154 arrangement of tile 110 are illustrative of methods for securing the floor tiles together without relying upon the bonding between subflooring and tile or between the vertical walls of abutting tiles.

Various modifications of the invention are possible without departing from the scope of the appended claims.

We claim:

1. A method of applying attrition resistant flooring to an area which includes the steps of:

placing a plurality of tiles in a central area, each tile having a plurality of strata bonded to each other, there being overhanging-underfitting relationship of straight line boundary portions which in the unadhered condition permits two adjacent tiles to be slideably adjustable with respect to each other, whereby each tile has overhanging-underfitting relationship with four adjacent tiles, said tiles having boundary portions adapted for an underfitting relationship along two edges which meet at a corner, said tiles being adhered to each other only at the overhanging-underfitting zone, each of said overhanging portions comprising a straight line tongue fitting into a groove of an adjacent tile, the depth of the groove being less than the magnitude of said overhanging portion, whereby the tongue may be conveniently inserted in the groove at the time of laying the floor there being a bottommost wafer board strata beneath the tongue strata;

trimming tiles at the periphery of the area; and anchoring selected tiles at the periphery of the area to the sub-flooring while retaining vent paths for diffusion of moisture to permit the moisture content of the sub-flooring and the moisture content of the atmosphere to equilibriate readily in such central area because of not using conventional adhesive relationship of the floor tiles and sub-flooring throughout such central area, a gas permeation zone being maintained between the vertical walls of said bottommost strata of adjacent tiles, there being no adhesive between said vertical walls.

* * * * *